US009783971B2

(12) United States Patent
Shinohara et al.

(10) Patent No.: US 9,783,971 B2
(45) Date of Patent: Oct. 10, 2017

(54) DISCHARGE VALVE APPARATUS AND ONE-PIECE FLUSH TOILET INCLUDING SAME

(71) Applicant: TOTO LTD., Kitakyushu-shi, Fukuoka (JP)

(72) Inventors: Koki Shinohara, Kitakyushu (JP); Atsuko Yamasaki, Kitakyushu (JP); Yukinori Kubozono, Kitakyushu (JP); Hideki Tanimoto, Kitakyushu (JP); Kenji Hatama, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 107 days.

(21) Appl. No.: 14/817,981

(22) Filed: Aug. 4, 2015

(65) Prior Publication Data

US 2016/0040417 A1 Feb. 11, 2016

(30) Foreign Application Priority Data

Aug. 8, 2014 (JP) ..... 2014-162762

(51) Int. Cl.
*E03D 11/10* (2006.01)
*E03D 1/34* (2006.01)
*E03C 1/12* (2006.01)

(52) U.S. Cl.
CPC ..... *E03D 1/34* (2013.01); *E03C 2001/1206* (2013.01)

(58) Field of Classification Search
CPC ... E03D 1/34; E03D 1/30; E03D 11/10; E03C 2001/1206; E03C 1/12
USPC ... 4/378, 379, 395, 397, 398, 405, 412, 434, 4/435
See application file for complete search history.

(56) References Cited

U.S. PATENT DOCUMENTS 1,379,712 A * 5/1921 Munkel ..... E03D 1/34 4/356
2,068,672 A * 1/1937 Groeniger ..... E03D 1/34 4/396
2,439,024 A * 4/1948 Ruebel ..... E03D 1/34 251/363
2,449,948 A * 9/1948 Milne ..... E03D 1/34 4/300
2,671,905 A * 3/1954 Krucki ..... E03D 1/34 251/359

(Continued)

FOREIGN PATENT DOCUMENTS

JP 2002-070109 A 3/2002
JP 2003-272003 A 9/2003

*Primary Examiner* — J. Casimer Jacyna
(74) *Attorney, Agent, or Firm* — Studebaker & Brackett PC

(57) ABSTRACT

A discharge valve apparatus of the present invention includes: a discharge portion main body member attached to discharge opening, forming the inside of discharge flow path for guiding flush water from an inflow opening formed at one end thereof to an outflow opening formed at the other end thereof; a valve body for opening and closing the inflow opening of the discharge portion main body member; and an affixing portion, formed to project into the discharge flow path of a discharge portion main body member, for affixing the discharge portion main body member to a reservoir tank; wherein the inside surface of side wall portion in the discharge portion main body member at the same height as this affixing portion forms a curved portion, which curves outward so as to expand the cross-sectional area of the flow path.

3 Claims, 11 Drawing Sheets

(56) References Cited

U.S. PATENT DOCUMENTS

| | | | | |
|---|---|---|---|---|
| 4,365,365 | A * | 12/1982 | Antunez | E03D 1/34 4/378 |
| 2004/0083542 | A1 * | 5/2004 | Oury | E03D 1/144 4/325 |
| 2010/0218308 | A1 * | 9/2010 | Schuster | E03D 1/14 4/325 |
| 2014/0059755 | A1 * | 3/2014 | Garrels | E03D 5/003 4/363 |

* cited by examiner

DISCHARGE VALVE APPARATUS AND ONE-PIECE FLUSH TOILET INCLUDING SAME

FIELD OF THE INVENTION

The present invention relates to a discharge valve apparatus and one-piece flush toilet including this discharge valve apparatus, and in particular relates to a discharge valve apparatus attached to a discharge opening on a flush water tank for storing flush water for flushing a toilet, and a one-piece flush toilet including this discharge valve apparatus.

BACKGROUND OF THE INVENTION

For some time, known discharge valve apparatuses attached to the discharge opening of a flush water tank for storing flush water for flushing a toilet have included those in which, as described, for example, in JP 2002-70109A (Patent Document 1), two locations on a discharge valve body portion are affixed using affixing hardware such as bolts to the discharge opening of a flush water tank on what is known as a one-piece flush toilet, in which the flush water tank portion and the toilet main body portion are integrally formed.

It is generally necessary in one-piece flush toilets to assure the greatest possible instantaneous flow rate of flush water supplied to the toilet main body portion from the flush water tank portion, but in the above-described conventional discharge valve apparatus the structure provides affixing hardware inside the discharge flow path of the discharge valve body portion, so the discharge flow path is narrowed by the area occupied by the affixing hardware. Therefore various design measures are employed in the toilet main body portion or the flush water tank portion to assure high instantaneous flow rate, such as setting a high initial water level in the flush water tank prior to start of discharge to create a high flush water head pressure, or setting a large diameter for the discharge opening.

On the other hand, known conventional flush toilets have included, in addition to the above-described one-piece flush toilets, what is known as two-piece flush toilets, wherein the flush water tank and toilet body are separately formed in advance, then the two are assembled.

In such two-piece flush toilets, unlike one-piece flush toilets, the discharge valve body portion can be affixed from the outside in advance to the discharge opening of a flush water tank with affixing members, prior to assembling the flush water tank to the toilet body, therefore no affixing hardware need be disposed inside the discharge flow path, and an appropriate flush water tank can be selected and assembled according to toilet body specifications, usage conditions, and required flush capability, so that the diameter of the flush water tank discharge opening can be standardized to predetermined measurements, and a common discharge valve apparatus can as much as possible be adopted to handle a diversity of toilet designs.

BRIEF SUMMARY OF THE INVENTION

Technical Problem

In recent years the standardization of flush water tank discharge opening diameter and of discharge valve apparatuses applied thereto has become a major issue, whether for one-piece or two-piece flush toilets, in order to respond to a greater diversity in the design of toilet bodies and flush water tanks and to the need for improved flushing performance, while also reducing manufacturing costs.

However, if the diameter of a flush water tank discharge opening for a one-piece flush toilet is made common with that of the diameter of a flush water tank discharge opening for a two-piece flush toilet, the problem that the discharge flow path is narrowed by the affixing hardware becomes unavoidable, and instantaneous flow rate diminishes compared to the case where no affixing hardware is placed in the discharge flow path, so that sufficient flushing performance cannot be attained for the toilet, making it difficult to apply a common shared discharge valve apparatus to both one-piece and two-piece flush toilets.

The present invention was undertaken to solve the above-described problems with the conventional art, and has the object of providing a discharge valve apparatus capable of supplying flush water from a flush water tank to a toilet at a high instantaneous flow rate, and of increasing toilet flushing performance and also applying standardization to various types of toilets and flush water tanks.

Solution to Problem

To accomplish the object above, the present invention is a discharge valve apparatus attached to the discharge opening of a flush water tank for storing flush water used to flush a toilet, including: a discharge portion main body attached to the discharge opening and forming the inside of a flow path for guiding flush water from an inflow opening formed at one end thereof to an outflow opening formed at the other end thereof; a discharge valve body for opening and closing the inflow opening of the discharge portion main body; and an affixing portion formed to project into the flow path of the discharge portion main body, for affixing the discharge portion main body to the flush water tank; wherein the wall surface of a flow path in the discharge portion main body at the same height as the affixing portion forms a curved portion which curves outward so as to expand the cross-sectional area of the flow path.

In the invention thus constituted, with respect to the instantaneous flow rate of flush water passing through a discharge portion main body flow path, even if an affixing portion is formed to project into the flow path of a discharge portion main body, by forming a curved portion in which the wall surface of a discharge body at the same height as the affixing portion curves outward so as to expand the flow path cross sectional surface area essentially the same instantaneous flow rate can be obtained as in the case where a different discharge portion main body, in which no affixing portion is disposed in the discharge portion main body flow path and the flow path cross sectional surface area is essentially fixed, is attached to the same diameter discharge opening in the flush water tank. In addition, even if an affixing portion is disposed inside a discharge portion main body flow path, the instantaneous flow rate of flush water flowing in the discharge portion main body flow path can be set to a high level due to the flow path space formed by the curved portion, even compared to yet another other discharge portion main body in which no curved portion is formed in the flow path wall surface. Therefore flush water flowing into the discharge portion main body flow path from a flush water tank can be efficiently supplied, and the flushing performance of the toilet improved. In addition, in the discharge valve apparatus of the present invention, with respect to both a discharge opening on a flush water tank to which a different discharge portion main body would normally be attached, in which no affixing portion is disposed in the discharge portion main body flow path, and with respect to a discharge opening on a flush water tank to which still another discharge portion main body would normally be attached, in which no curved portion is formed in the flow path wall surface, even if an affixing portion is disposed in the discharge portion main body flow path: so long as the discharge opening has the same diameter, the discharge portion main body in the discharge valve apparatus of the present invention can be easily attached. Therefore even compared to a case in which these other discharge portion bodies are attached to a discharge opening, a relatively high instantaneous flow rate can be secured without reducing the instantaneous flow rate of flush water supplied from the flush water tank to the toilet through the flow path of the discharge portion main body. Therefore standardization of the discharge valve apparatus can be applied to various toilets and flush water tanks, improving ease of use.

In the present invention the affixing portion is preferably such that the surface forming the flow path is formed in a curved shape.

In the invention thus constituted, the surface of the affixing portion forming the flow path of the discharge portion main body is formed in a curved shape, therefore when flush water in the flush water tank flows from an inflow opening in the discharge portion main body into a flow path, passing over the curved surface of the affixing portion, the flush water is able to flow smoothly along the curved surface of the affixing portion without peeling away. Therefore a relatively high instantaneous flow rate of flush water can be supplied from the flush water tank to the toilet. Hence even if an affixing portion is formed inside a discharge portion main body flow path, flush water at a relatively high instantaneous flow rate can be supplied to the toilet without impedance of the flow of flush water flowing into the discharge portion main body flow path from the flush water tank and over the affixing portion, and toilet flushing performance can be improved.

In the present invention the flow path in the discharge portion main body preferably includes an area in which the affixing portion surface and the flow path wall surface are formed in a curved shape so that the flow path surface area is essentially the same along the height direction of the affixing portion.

In the invention thus constituted, the flow path in the discharge portion main body includes an area in which the affixing portion surface and the flow path wall surface are formed in a curved shape so that the flow path cross sectional surface area is essentially the same along the height direction of the affixing portion; therefore even if an affixing portion is formed inside the flow path of a discharge portion main body, flush water is able to flow smoothly along the surface of the curved affixing portion or the wall surface of the curved flow path without peeling away, and a relatively high instantaneous flow rate can be secured. Therefore a relatively high instantaneous flow rate of flush water can be supplied to a toilet from a flush water tank through a discharge portion main body flow path, and the flushing performance of the toilet improved.

In the present invention the discharge portion main body flow path is preferably formed so that the flow path surface area expands going from the top end portion of the wall surface thereof toward the upstream inflow opening.

In the invention thus constituted, the flow path of the discharge portion main body is formed so that the flow path cross sectional surface area expands proportionally going from the top end portion of the wall surface thereof toward the upstream inflow opening, therefore flush water in the flush water tank is able to flow smoothly from the inflow opening along the flow path wall surface without peeling away when flowing into the flow path from the inflow opening of the discharge portion main body. Therefore a relatively high instantaneous flow rate of flush water can be supplied to a toilet from a flush water tank through a discharge portion main body flow path, and the flushing performance of the toilet can be improved.

Next, the present invention is a one-piece flush toilet including a flush water tank in which the discharge valve apparatus is attached to the discharge opening, and a toilet body with which this flush water tank is integrally formed.

In the invention thus constituted, flush water can be supplied at a relatively high instantaneous flow rate from the flush water tank to the toilet body, thereby improving toilet flushing performance.

In the invention thus constituted, flush water at a high instantaneous flow rate can be supplied from a flush water tank to a toilet, thereby improving toilet performance, while at the same time the invention can be applied to the standardization of various toilets and flush water tanks.

DETAILED DESCRIPTION OF THE INVENTION

Next, using the attached drawings, we explain a discharge valve apparatus according to an embodiment of the invention.

Figure 1:
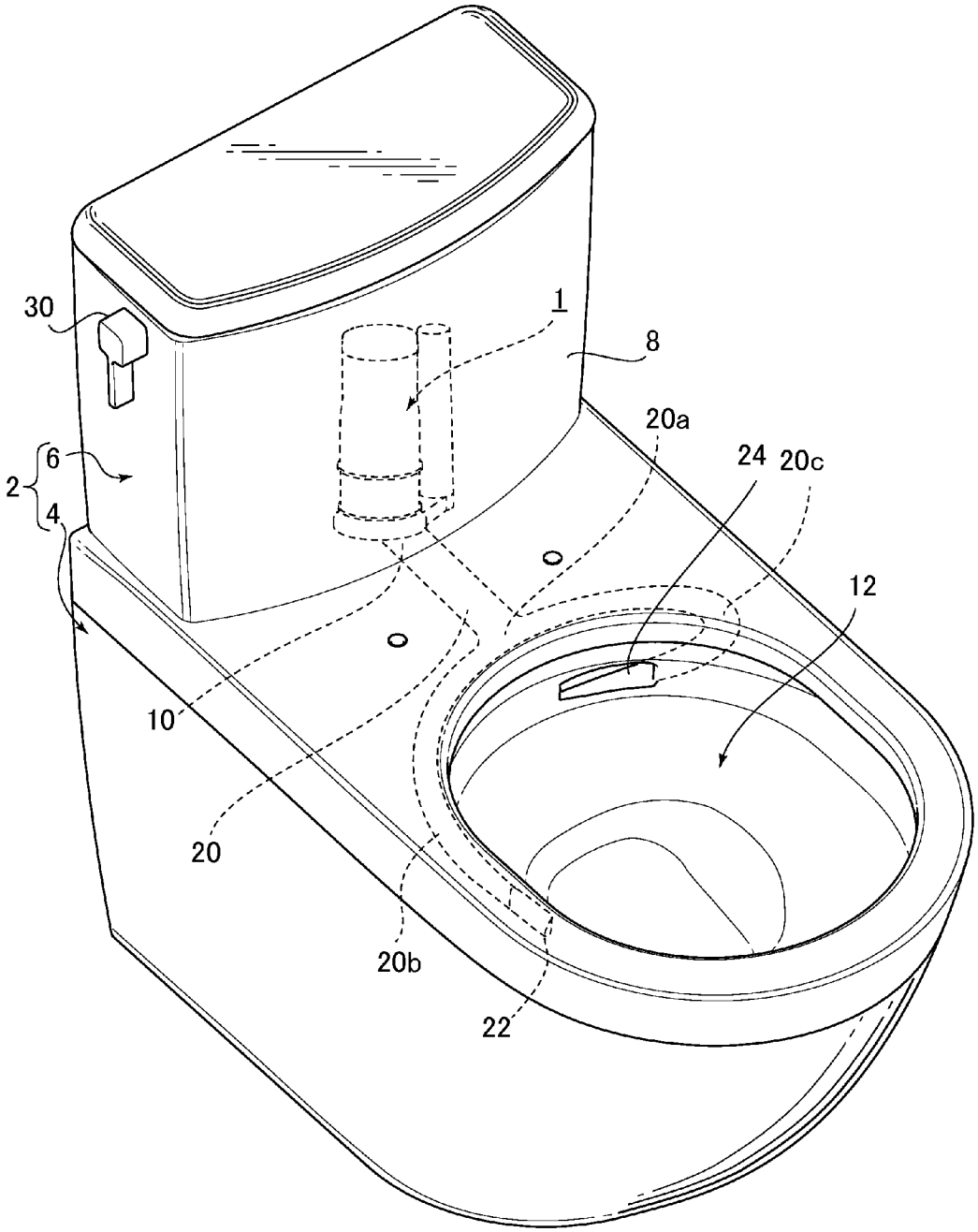
FIG. 1 is a perspective view of a one-piece flush toilet to which a discharge valve apparatus according to an embodiment of the invention is applied.
Figure 2:
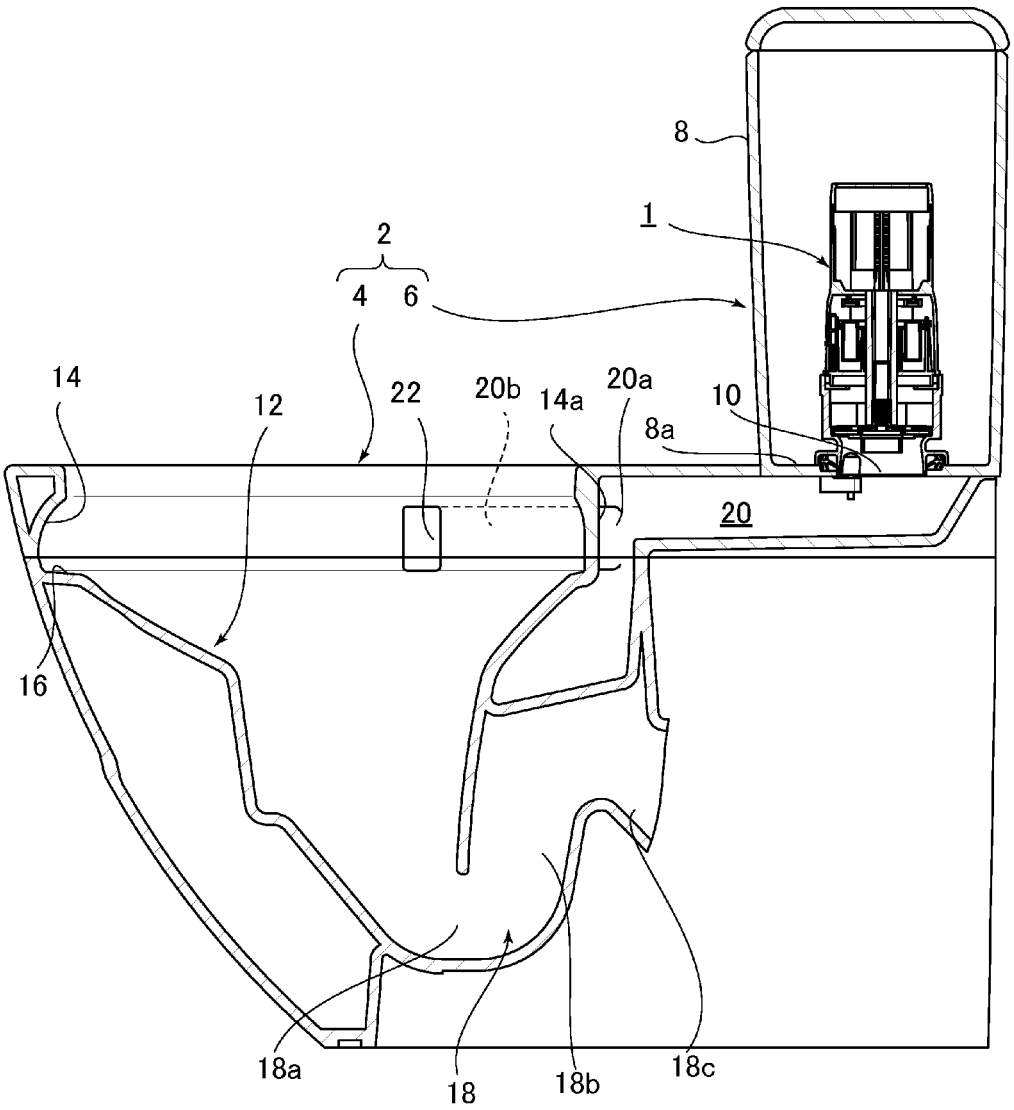
FIG. 2 is a side elevation cross section of a one-piece flush toilet to which a discharge valve apparatus according to an embodiment of the invention is applied.

First, referring to FIGS. 1 and 2, we explain a one-piece flush toilet to which a discharge valve apparatus according to an embodiment of the invention is applied.

FIG. 1 is a perspective view of a one-piece flush toilet to which a discharge valve apparatus according to an embodiment of the invention is applied; FIG. 2 is a side elevation cross section of a one-piece flush toilet to which a discharge valve apparatus according to an embodiment of the invention is applied.

As shown in FIGS. 1 and 2, a one-piece flush toilet 2, to which a discharge valve apparatus 1 according to an embodiment of the invention is applied, includes: a toilet main body portion 4 and a flush water tank portion 6 integrally formed at the rear of the top surface of the toilet main body portion 4. The flush water tank portion 6 includes a reservoir tank 8 for storing flush water to the flush the toilet. A discharge opening 10 penetrating in the vertical direction is provided at the bottom portion 8*a* of this reservoir tank 8. More precisely, this discharge opening 10 corresponds to an attachment hole 8*b* at the bottom portion 8*a* of the reservoir tank 8, to which the discharge valve apparatus 1 of the present embodiment, described in detail below, is attached.

The toilet main body portion 4 of the flush toilet 2 includes a bowl portion 12 disposed at the front side thereof, a rim portion 14 formed on the top edge of this bowl portion 12, and a shelf portion 16 formed on the inside perimeter of this rim portion 14.

The inlet 18*a* of a discharge trap conduit 18 is opened on the bottom portion of the bowl portion 12 on the toilet main body portion 4, and this discharge trap conduit 18 includes an upwardly extending ascending pipe 18*b* and a downwardly extending descending pipe 18*c*. As can be understood from the shape of this discharge trap conduit 18, the flush toilet 2 of the present embodiment is what is known as a siphon type of flush toilet, wherein waste in the bowl portion is suctioned in and discharged in one burst outward from a discharge trap conduit using the siphon effect.

Note that the flush toilet 2 is not limited to a siphon flush toilet, and may also be applied to other types of flush toilet, such as what is known as a washdown type of flush toilet, wherein waste is pushed out by the flow effect created by the water drop inside the bowl portion.

Next, the toilet main body portion 4 includes a water conduit 20 into which flows flush water discharged from the discharge opening 10 of the flush water tank portion 6; a first rim spout opening 22 formed at the left center as seen from the front of the rim portion 14; and a second rim spout opening 24 (see FIG. 1) formed at the right center as seen from the front of the rim portion 14.

Also, water conduit 20 includes a first water conduit 20*b* which, after extending in the downstream direction to water conduit branching area 20*a* in the vicinity of the rear wall surface 14*a* of the rim portion 14, extends from this water conduit branching area 20*a* to first rim spout opening 22; and a second water conduit 20*c* extending from the water conduit branching area 20*a* to the second rim spout opening 24; the flush water in the water conduit 20 passes from the water conduit branching area 20*a* through the first water conduit 20*b* to reach the first rim spout opening 22, while also passing from the water conduit branching area 20*a* through the second water conduit 20*c* to reach the second rim spout opening 24, to be spouted from the first rim spout opening 22 and the second rim spout opening 24, respectively, so that the bowl portion 12 is flushed and waste is discharged from the discharge trap conduit 18.

Figure 3:
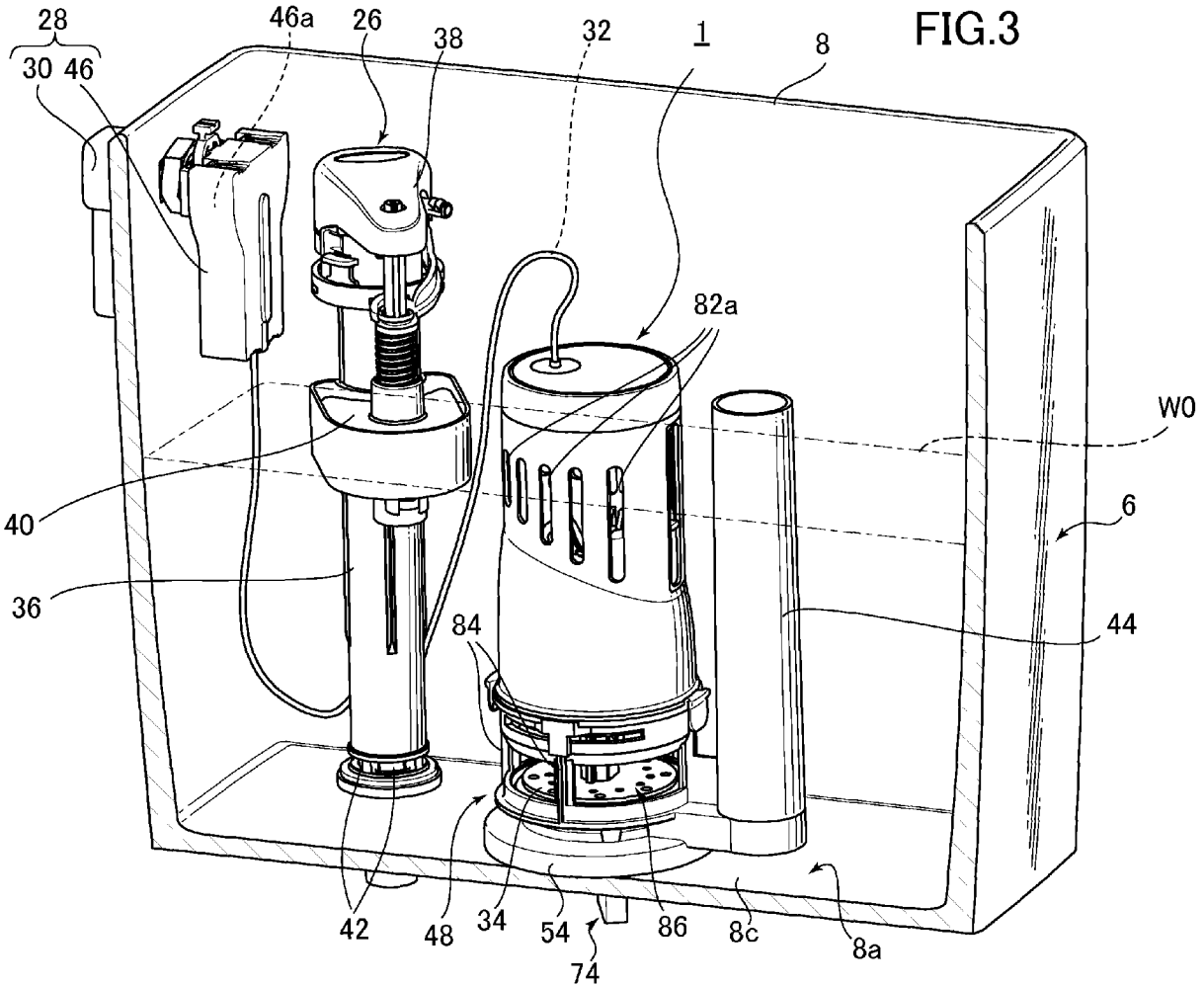
FIG. 3 is a perspective view, seen from a position diagonally forward and above, of the internal structure of a flush water tank portion of a one-piece flush toilet to which a discharge valve apparatus according to an embodiment of the invention is applied, with the top lid and front wall surface of the flush water tank omitted.

Next, referring to FIGS. 2 and 3, we explain the internal structure of a one-piece flush toilet flush water tank portion to which a discharge valve apparatus according to an embodiment of the invention is applied.

FIG. 3 is a perspective view, seen from a position diagonally forward and above, of the internal structure of a flush water tank portion of a one-piece flush toilet to which a discharge valve apparatus according to an embodiment of the invention is applied, with the top lid and front wall surface of the flush water tank omitted.

As shown in FIGS. 2 and 3, the followings are installed in the reservoir tank 8 of a flush water tank portion 6 in a one-piece flush toilet 2 to which a discharge valve apparatus 1 according to an embodiment of the invention is applied: a water supply apparatus 26 for supplying flush water into the reservoir tank 8, and a discharge valve apparatus 1, described in detail below, for opening a discharge opening 10 to allow the flush water stored in the reservoir tank 8 to flow out to the water conduit 20 on the toilet main body portion 4. This discharge valve apparatus 1 is what is known as a wire drive direct acting type of discharge valve apparatus, wherein a valve body 34 rises as the result of a single operating wire 32 being pulled up by operation of operating lever 30 on operating apparatus 28, thereby the opening discharge opening 10 on the reservoir tank 8.

The water supply apparatus 26 includes a water supply pipe 36, connected to an external water supply source (not shown) and disposed to extend upward from the bottom portion of the reservoir tank 8; a water supply valve 38, attached to the top end portion of this water supply pipe 36, for switching between spouting water into and shutting water off from the reservoir tank 8 for flush water supplied from the water supply pipe 36; and a float 40, for moving up and down in response to fluctuations in the water level inside the reservoir tank 8, thereby switching between spouting and shutting off water using the water supply valve 38.

Multiple spout openings 42 are formed on the bottom end portion of the outside perimeter of the water supply pipe 36, and flush water passing through the water supply valve 38 is spouted from the spout openings 42 into the reservoir tank 8.

In the water supply apparatus 26, when flush water in the reservoir tank 8 is discharged into the toilet by the discharge valve apparatus 1, the flush water level drops and the float 40 falls; this causes the water supply valve 38 to open so that spouting from the spout openings 42 is started, and the spouting into the reservoir tank 8 from a water supply source (not shown) outside the flush water tank portion 6 is started.

In addition, the float 40 rises when the water spouting continues and the water level inside the reservoir tank 8 rises, thereby closing the water supply valve 38 so that the spouting from spout openings 42 is shut off. By this means the flush water level inside the reservoir tank 8 is maintained at a predetermined water level when full ("full water level W0" below). Here, the full water level W0 also corresponds to the initial water level inside the reservoir tank 8 prior to the start of discharge.

Note that an explanation of the water supply apparatus 26 is omitted in this embodiment, but it includes a refill pipe (not shown) and the like, and a part of the flush water flowing out from this refill pipe (not shown) can flow into the overflow pipe 44 and be supplied through the water conduit 20 of the toilet main body portion 4 as refill water into the bowl portion 12.

As shown in FIG. 3, operating apparatus 28, which operates the discharge valve apparatus 1, includes an operating lever 30 attached to the outside of the reservoir tank 8, and a wire take-up apparatus 46 disposed inside the reservoir tank 8 and linked to the operating lever 30. This wire take-up apparatus 46 is arranged so that the rotational force when the operating lever 30 is manually rotated is transferred to a rotation mechanism member (not shown), such as a pulley or gear inside casing 46*a* of the wire take-up apparatus 46. The wire take-up apparatus 46 and the discharge valve apparatus 1 are mutually linked by the operating wire 32, and the manual rotation of the operating lever 30 on the operating apparatus 28 results in a single operating wire 32 being raised via the wire take-up apparatus 46 so that the valve body 34 rises and the discharge opening 10 on the reservoir tank 8 is opened.

Note that in the present embodiment we explain an example in which a wire take-up apparatus 46 can be operated by the manual rotation of the operating lever 30 on the operating apparatus 28 to raise the operating wire 32, but a push button or similar means could be adopted instead of the operating lever 30, and it would also be acceptable to provide a drive means such as a motor to rotate the operating lever so that the operating lever or wire take-up apparatus is electrically driven. It would also be acceptable to adopt an operating format in which operation of the drive means is automatically controlled using a command signal from an externally set operating button or a human body detecting sensor.

Next, referring to FIGS. 1 through 11, we discuss details of a discharge valve apparatus according to an embodiment of the invention.

Figure 4:
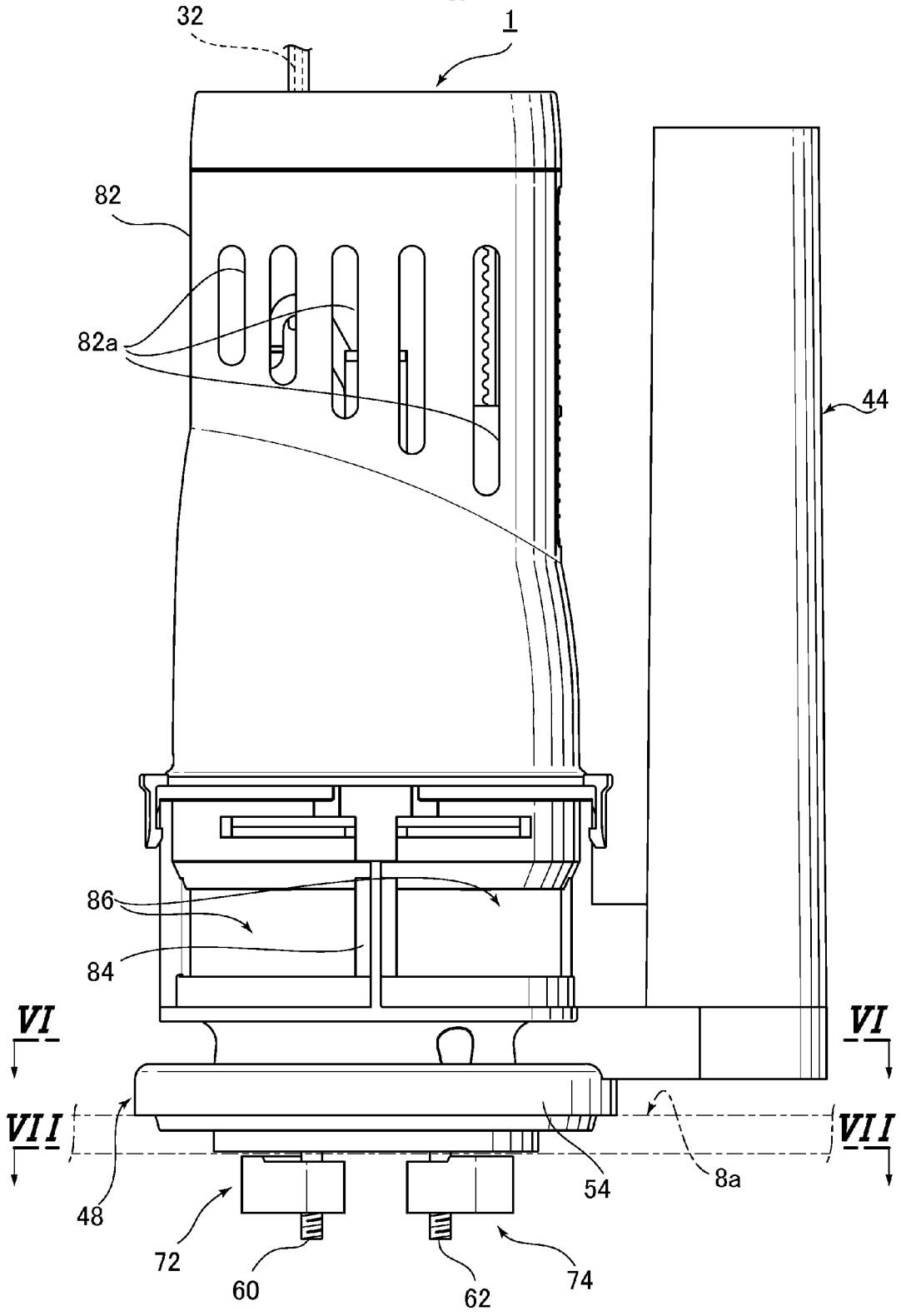
FIG. 4 is a front elevation showing a discharge valve apparatus according to an embodiment of the invention.
Figure 5:
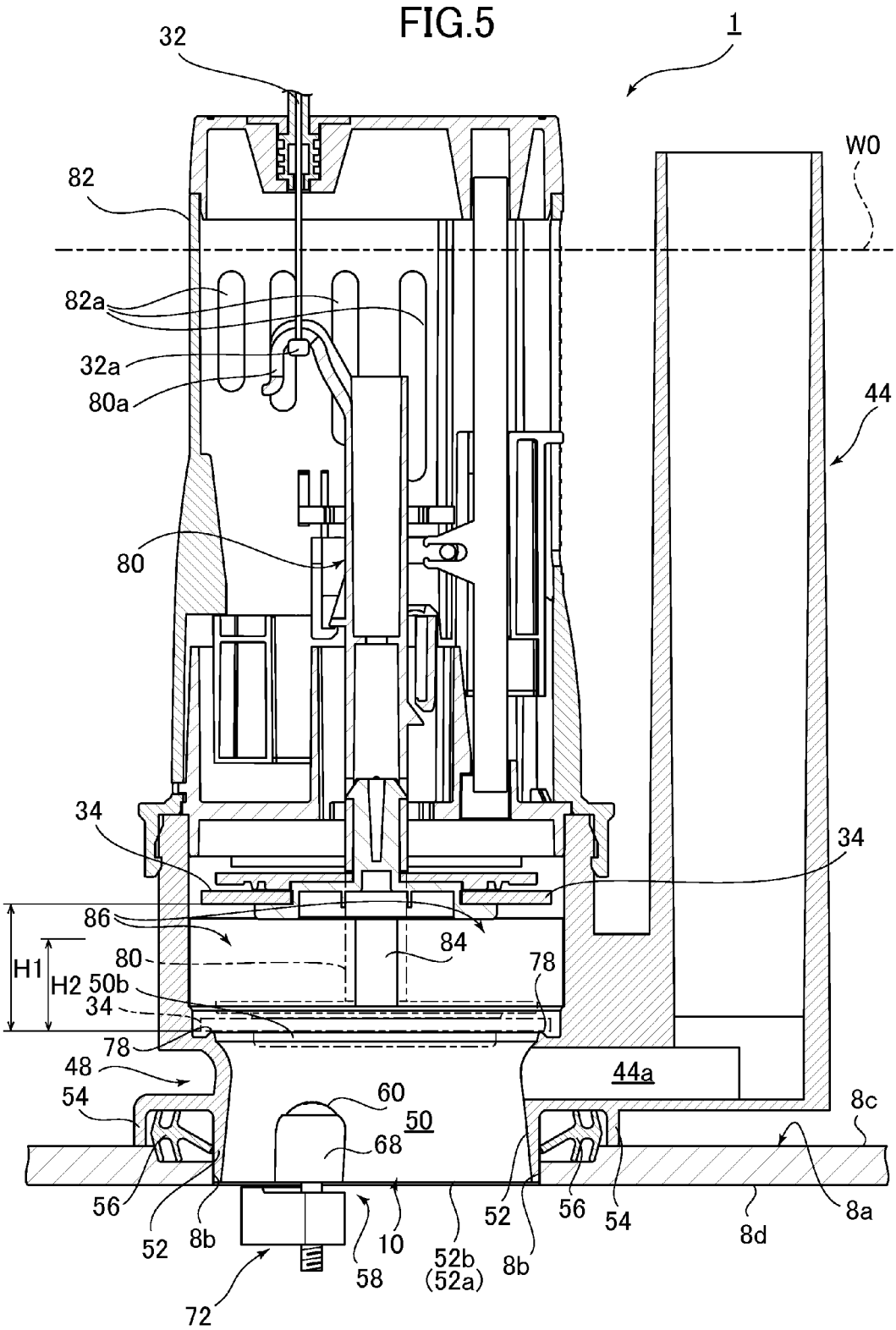
FIG. 5 is a front cross section showing a discharge valve apparatus according to an embodiment of the invention.
Figure 6:
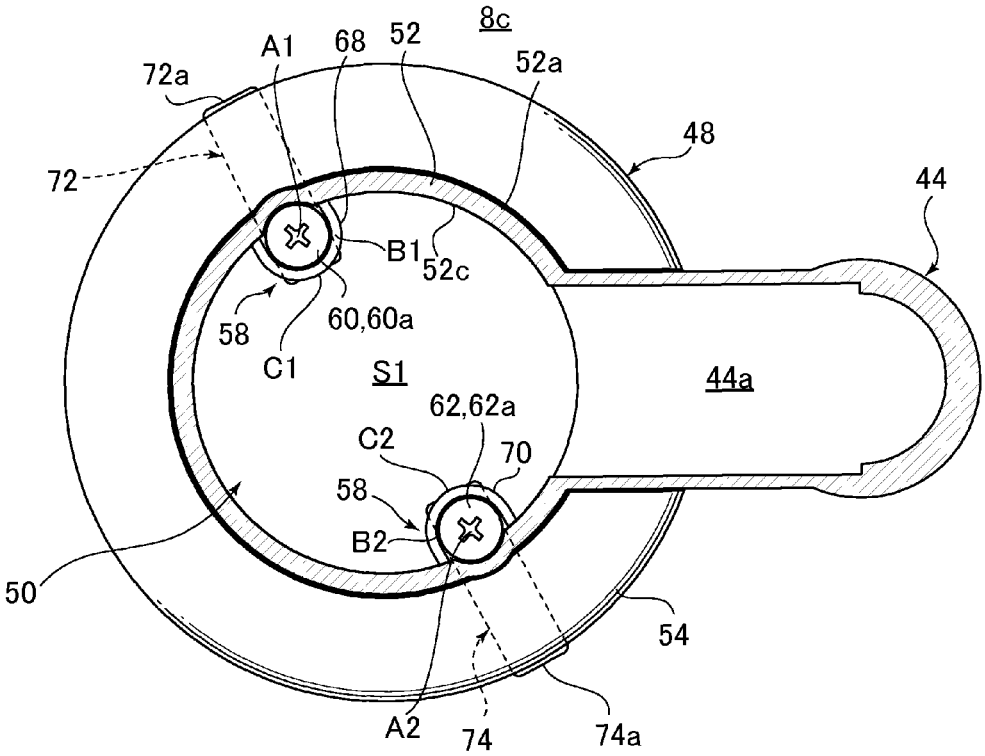
FIG. 6 is a cross section seen along line VI-VI in FIG. 4.
Figure 7:
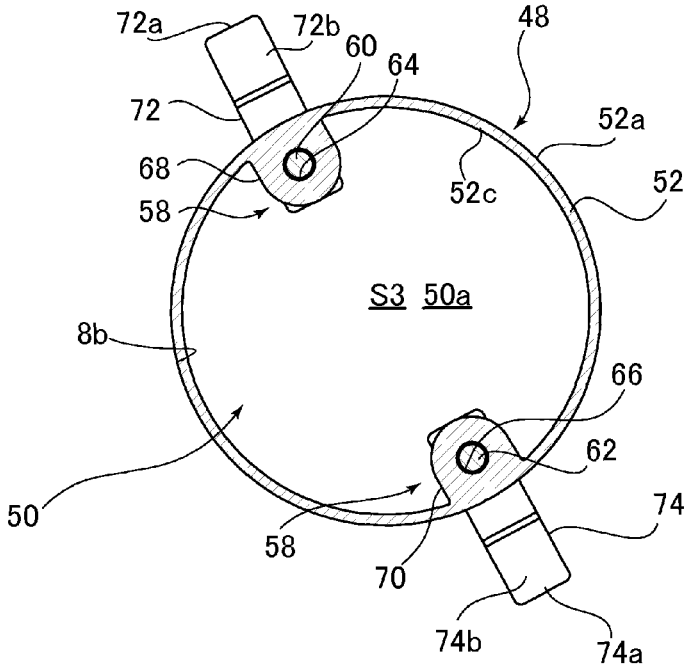
FIG. 7 is a cross section seen along line VII-VII in FIG. 4.
Figure 8:
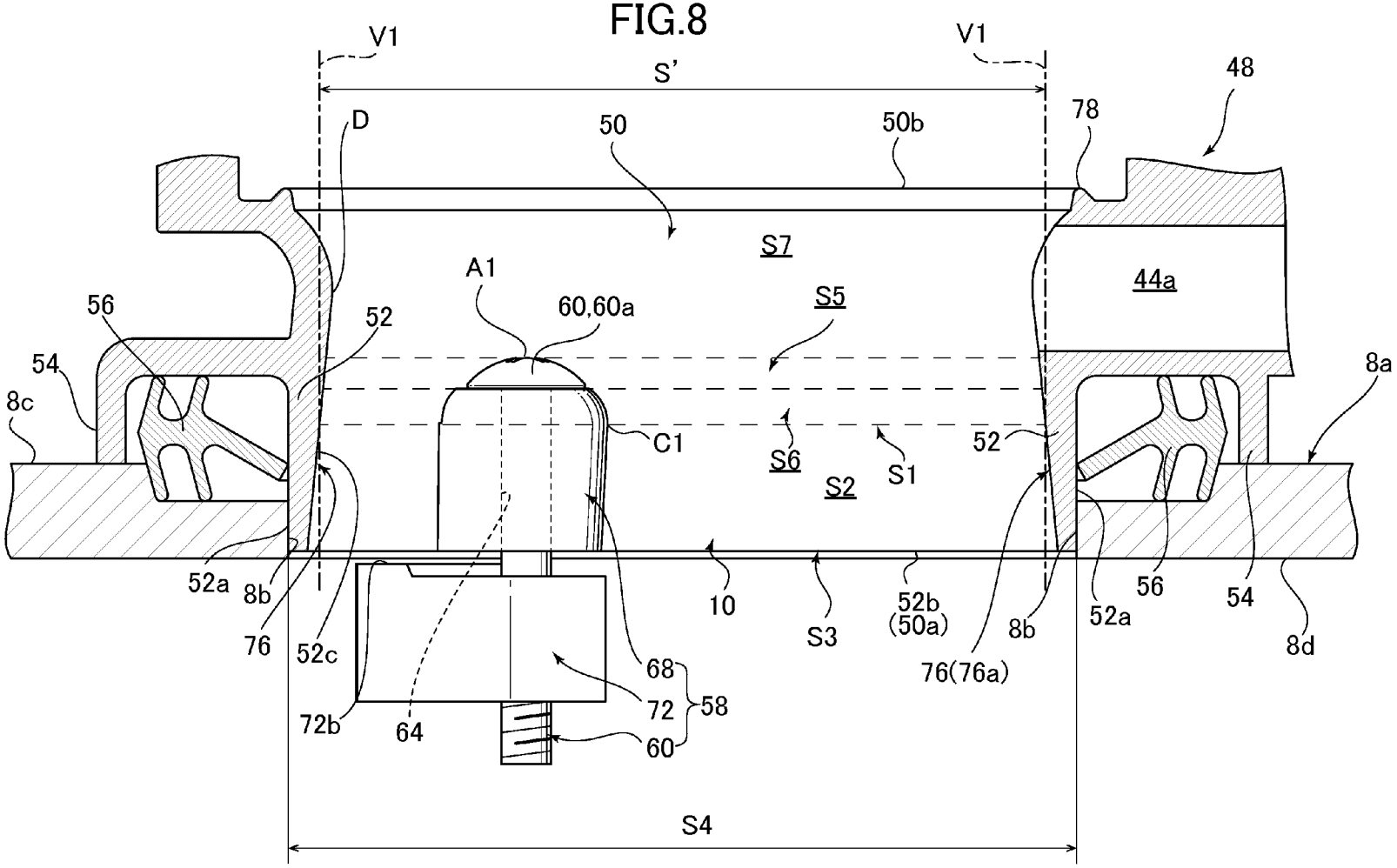
FIG. 8 is an expanded cross section expanding the bottom portion of a discharge valve apparatus according to an embodiment of the invention shown in FIG. 5.

First, FIG. 4 is a front elevation showing a discharge valve apparatus according to an embodiment of the invention; FIG. 5 is a front elevation cross section showing a discharge valve apparatus according to an embodiment of the invention. FIG. 6 is a cross section seen along line VI-VI in FIG. 4, and FIG. 7 is a cross section seen along line VII-VII in FIG. 4. In addition, FIG. 8 is an expanded cross section expanding the bottom portion of a discharge valve apparatus according to the embodiment of the invention shown in FIG. 5.

As shown in FIGS. 3 through 8, the discharge valve apparatus 1 of the present embodiment includes a discharge portion main body member 48, attached to the attachment hole 8*b* on the bottom portion 8*a* of the reservoir tank 8 and forming a discharge opening 10 communicating with the water conduit 20 on the toilet main body portion 4. An overflow pipe 44 extending in the up-down direction is disposed on the side of the discharge portion main body member 48; the downstream-side end portion of this downward flow path 44*a* inside the overflow pipe 44 communicates with a discharge flow path 50 formed on the inside of discharge portion main body member 48.

As shown in FIGS. 3 through 8, discharge portion main body member 48 includes a side wall portion 52, which forms a tubular discharge flow path 50 and is attached to the attachment hole 8*b* on the bottom portion 8*a* of the reservoir tank 8; and a base portion 54, formed in a ring shape at predetermined spacing on the outside of this side wall portion 52, and attached to the top side surface 8*c* of the bottom portion 8*a* of reservoir tank 8.

In addition, as shown in FIGS. 5 through 8, a seal member 56 such as packing or the like is attached in the ring-shaped space formed between the side wall portion 52 and the base portion 54, and the flush water outside the base portion 54 is sealed by this seal member 56 from leaking out from the gap between the attachment hole 8*b* on the bottom portion 8*a* of reservoir tank 8 and the outside surface 52*a* of side wall portion 52.

Also, as shown in FIGS. 5 through 8, the outside surface 52*a* of the side wall portion 52 on the discharge portion main body member 48 is inserted into the attachment hole 8*b* on the bottom portion 8*a* of the reservoir tank 8 extending further down than the bottom surface of the seal member 56, and is positioned so be essentially flush with the bottom side surface 8*d* of the bottom portion 8*a* of the reservoir tank 8, forming the outflow opening 50*a* of the discharge flow path 50.

Next, as shown in FIGS. 5 through 8, the discharge valve apparatus 1 includes an affixing portion 58, attached to the attachment hole 8*b* in the bottom portion 8*a* of the reservoir tank 8, for affixing the discharge portion main body member 48. This affixing portion 58 includes a pair of countersunk screws 60, 62.

Also, the affixing portion 58 includes a pair of countersunk screw attaching portions 68, 70, integrally formed on the inside surface 52*c* of the side wall portion 52 of the discharge portion main body member 48 to project into the discharge flow path 50, in such a way that attaching holes 64, 66 for countersunk screws 60, 62 penetrate vertically.

In addition, the affixing portion 58 also includes a pair of affixing hardware 72, 74 respectively engaging the lower part of each of the countersunk screws 60, 62 attached to each of the countersunk screw attaching portions 68, 70.

As shown in FIG. 7, the outside tip portions 72*a*, 74*a* on the affixing hardware 72, 74 are positioned further out than the side wall portion 52 of the discharge portion main body member 48, and as shown in FIG. 8, each of the affixing hardware 72, 74 is positioned below the bottom end surface 52*b* of the side wall portion 52 on the discharge portion main body member 48.

As shown in FIGS. 6 through 8, the affixing hardware 72, 74 can be adjusted to rise by turning the countersunk screws 60, 62 about their center axis in the tightening direction, and by bringing the top surfaces 72*b*, 74*b* of the outside tip portions 72*a*, 74*a* of each affixing hardware 72, 74 into contact with the bottom side surface 8*d* of the bottom portion 8*a* on the reservoir tank 8, the bottom portion 8*a* of the reservoir tank 8 is held between the base portion 54 on the upper discharge portion main body member 48 and the affixing hardware 72, 74. If the countersunk screws 60, 62 are completely tightened with the bottom portion 8*a* of the reservoir tank 8, which are held in this way between the base portion 54 of the discharge portion main body member 48 and each of the affixing hardware 72, 74, the discharge portion main body member 48 will be fully affixed to the bottom portion 8*a* of the reservoir tank 8.

Figure 9:
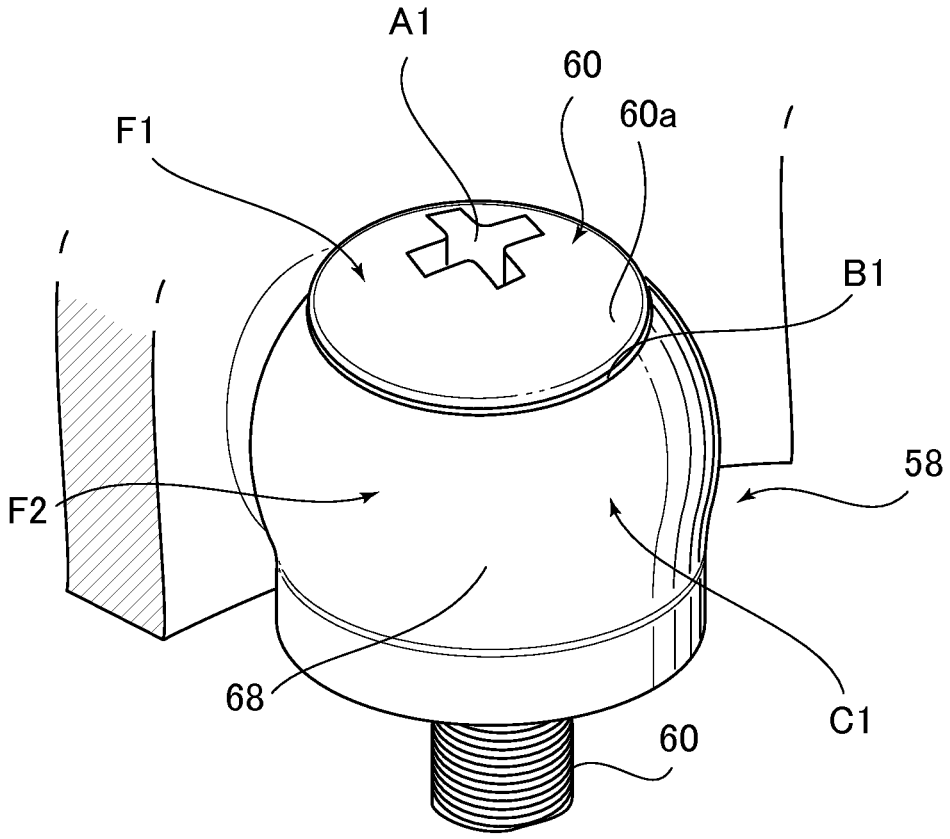
FIG. 9 is a perspective view of the affixing portion of a discharge valve apparatus according to an embodiment of the invention, as seen diagonally from above.
Figure 10:
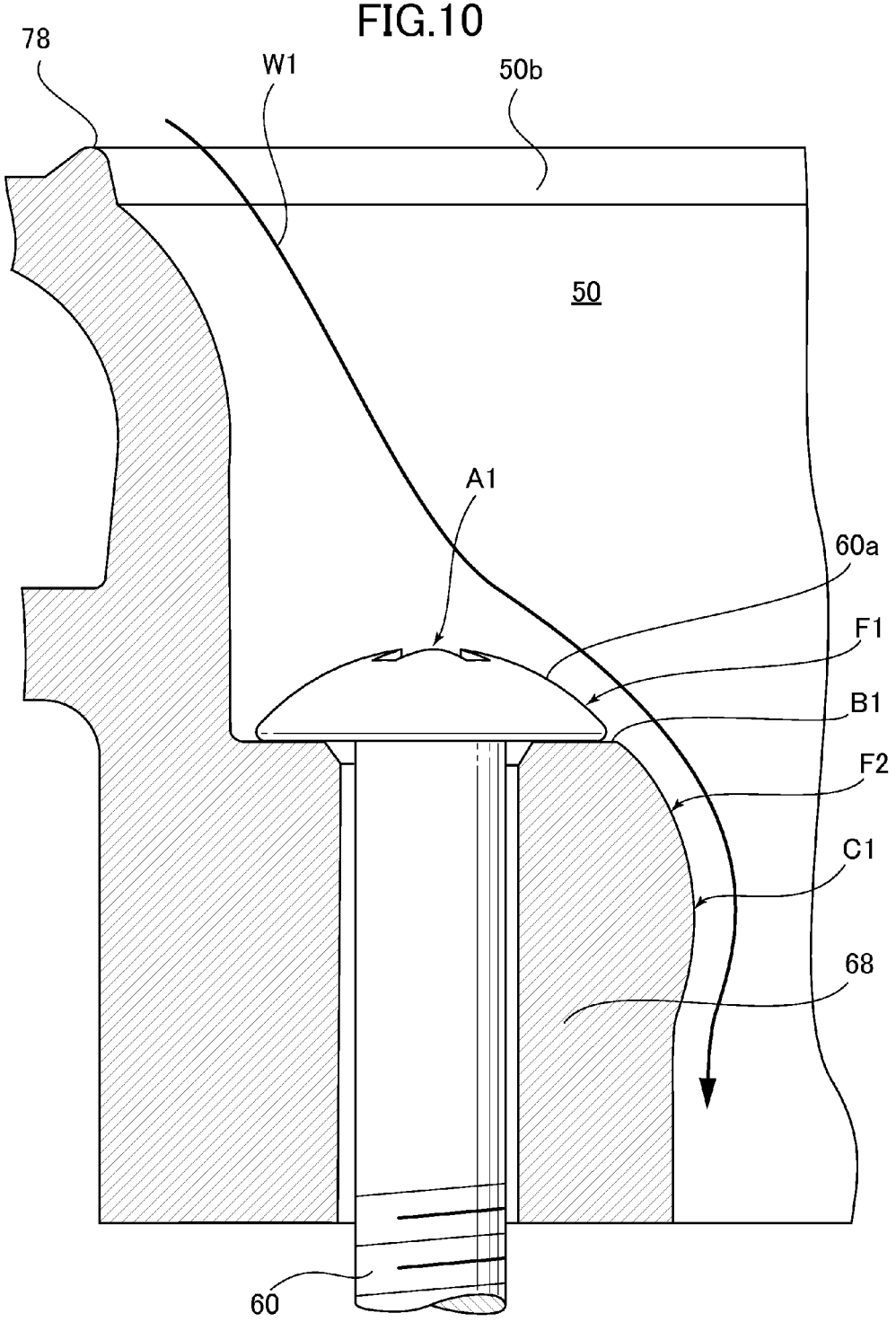
FIG. 10 is an expanded cross section partially expanding the affixing portion of a discharge valve apparatus according to an embodiment of the invention.
Figure 11:
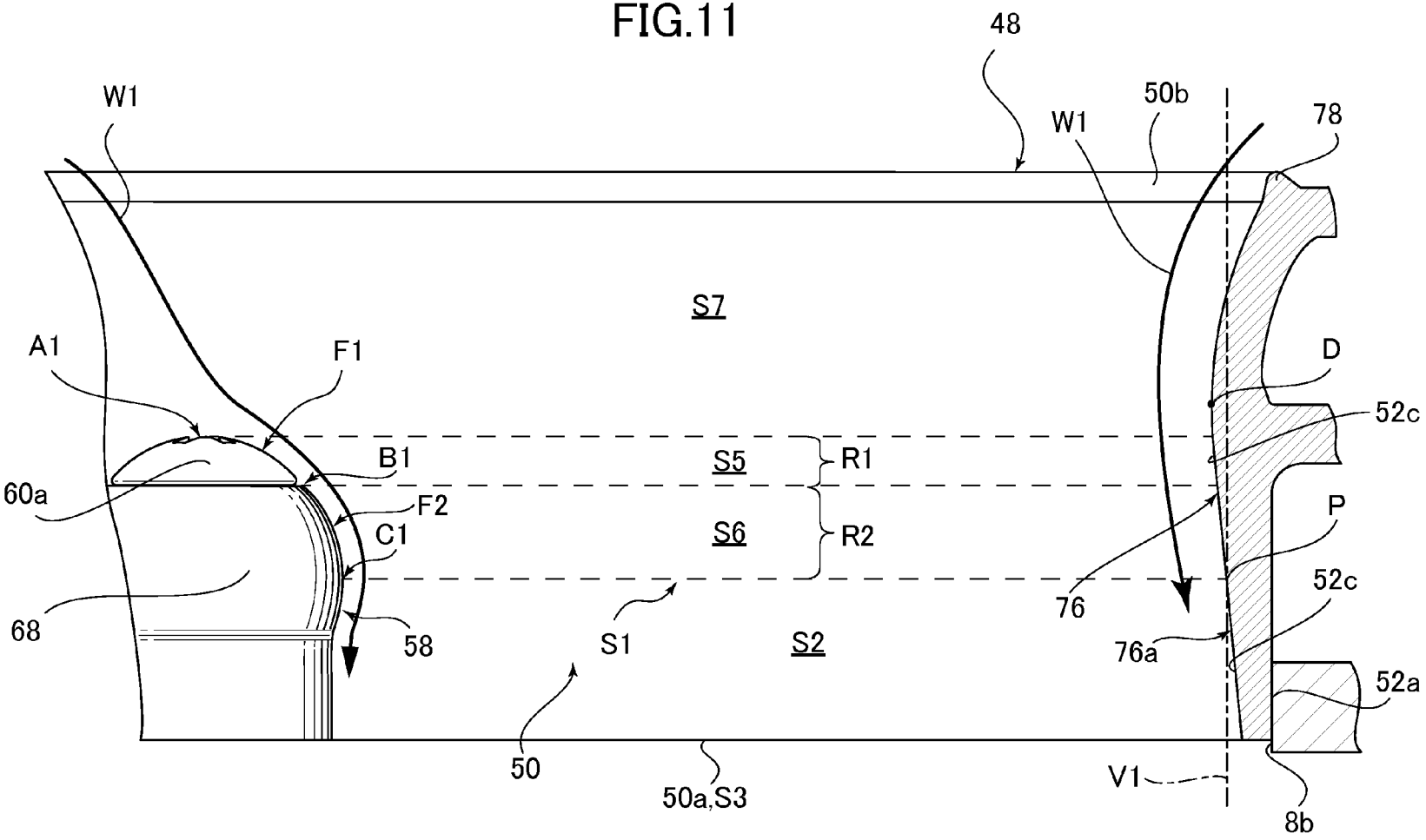
FIG. 11 is an expanded front elevation partially expanding the flow path and the affixing portion of a discharge portion main body member in a discharge valve apparatus according to an embodiment of the invention.

Next, FIG. 9 is a perspective view of the affixing portion of a discharge valve apparatus according to an embodiment of the invention, as seen diagonally from above; FIG. 10 is an expanded cross section partially expanding the affixing portion of a discharge valve apparatus according to an embodiment of the invention; FIG. 11 is an expanded front elevation partially expanding the flow path and the affixing portion of a discharge portion main body member in a discharge valve apparatus according to an embodiment of the invention.

As shown in FIGS. 6 through 11, in a state wherein the countersunk screws 60, 62 are attached to each of the countersunk screw attaching portions 68, 70, the total surface F1 from the peaks A1, A2 of the countersunk screws 60, 62 to the outside perimeters of the head portions 60*a*, 62*a*, and the surface F2 from the top end portion B of the countersunk screw attaching portions 68, 70 to the innermost portions C1, C2 protruding out furthest inward around essentially the middle height, are formed into a mutually continuous curved shape, and the entirety of both the surface F1 and the surface F2 is formed into a semi-spherical shape. Thus, as shown by the arrow W1 indicating flush water flow, the flush water in the reservoir tank 8 flows from an inflow opening 50*b* on the discharge portion main body member 48 into the discharge flow path 50; when it passes over the curved surfaces F1, F2 on the affixing portion 58, the flush water W1 is able to flow smoothly without peeling away from the curved surfaces F1, F2, and the flush water at a relatively high instantaneous flow rate Q [L/min] can be supplied from the reservoir tank 8 to the toilet main body portion 4 of the one-piece flush toilet 2.

Also, as shown in FIG. 6 and FIGS. 8 through 11, the flow path cross sectional surface area S1 of the parts other than the affixing portion 58 inside the discharge flow path 50 of the discharge portion main body member 48 at the same height position P as the innermost portions C1, C2 of the affixing portion 58 is minimal, but on the wall surface of the side wall portion 52 (the inside surface 52*c*) forming the discharge flow path 50 in the area downstream of position P at the same height as these innermost portions C1, C2, a curved portion 76 (a downstream side curved portion 76*a*), curved so as to gradually widen outward in the downward direction, is formed so that the flow path cross sectional surface area S2 of parts other than the affixing portion 58 gradually expands toward the outflow opening 50*a* with downstream-side flow path cross sectional surface area S3 (S3>S2). Thus with respect to the instantaneous flow rate Q [L/min] of the flush water passing through the discharge flow path 50 of the discharge portion main body member 48, a relatively high instantaneous flow rate can be secured even if the affixing portion 58 is formed to project into the discharge flow path 50 of the discharge portion main body member 48.

As shown in FIGS. 8 and 11, the diameter dimensions of the discharge flow path 50 side wall portion 52 outside surface 52*a* and the reservoir tank 8 bottom portion 8*a* attachment hole 8*b* are set to be fixed in the up-down direction, and the outside diameter of the side wall portion 52 outside surface 52*a* and the flow path cross sectional surface area S4 of the reservoir tank 8 bottom portion 8*a* attachment hole 8*b* are also set to be fixed in the up-down direction, and set to be slightly larger than the outflow opening 50*a* flow path cross sectional surface area S3.

Note that we explain for the discharge valve apparatus 1 of the present embodiment the case in which the invention is applied to a one-piece flush toilet 2 in which the toilet main body portion 4 and the flush water tank portion 6 are integrally formed, but the invention is not limited thereto, and the invention may also be easily applied to a two-piece flush toilet including a reservoir tank with the same diameter attachment hole as the attachment hole 8*b* on the bottom portion 8*a* of the reservoir tank 8 in the flush water tank portion 6 of the flush toilet 2 in the one-piece flush toilet to which it is applied.

Also, in FIGS. 8 and 11, as a discharge flow path in a discharge portion main body member according to a comparative example to the discharge portion main body member 48 of the discharge valve apparatus 1 in the embodiment, the inside wall and its extended surface for a virtual discharge flow path portion different from the discharge flow path 50 in the discharge valve apparatus 1 of the embodiment are indicated by dot and dash line V1. In the discharge portion main body member discharge flow path of this comparative example, the flow path cross sectional surface area S' is fixed from the inflow opening to the outflow opening thereof.

The flow path cross sectional surface area S' of the discharge flow path in the discharge portion main body member of the comparative example is the flow path cross sectional surface area at the same height position P as the innermost portions C1, C2 of the discharge flow path 50 in the discharge valve apparatus 1, and is larger than the flow path cross sectional surface area S1 of the innermost portions C1, C2 of the discharge flow path 50 in the discharge valve apparatus 1 to the extent that no affixing portion 58 is disposed in the discharge flow path.

However, in the discharge valve apparatus 1 of the embodiment, the flow path cross sectional surface area S2 of the parts other than the affixing portion 58 gradually expands more than flow path cross sectional surface area S1 toward the downstream side, due to the curved portion 76 (downstream side curved portion 76*a*) formed on the side wall portion 52 (the inside surface 52*c*) of the discharge flow path 50 in the area further downstream than position P at the same height as the innermost portions C1, C2 of the discharge flow path 50. Therefore essentially the same instantaneous flow rate can be attained even if the affixing portion 58 is disposed inside the discharge flow path 50 of the present embodiment, even when compared to the case in which a discharge portion main body member in a comparative example is attached to the attachment hole 8*b* of the same diameter in the bottom portion 8*a* of the reservoir tank 8.

Even compared to a discharge portion main body member discharge flow path according to still another comparative example, in which the same affixing portion 58 as in the present embodiment is disposed on the inside surface V1 of the side wall portion of a discharge flow path in a discharge portion main body member according to the above-described comparative example, the instantaneous flow rate Q [L/min] of the flush water flowing in the discharge flow path 50 of the discharge portion main body member 48 can be set high due to the widened space inside the discharge flow path 50 formed by the curved portion 76 (downstream side curved portion 76*a*) of the present embodiment.

Moreover, in the discharge valve apparatus 1 of the present embodiment, if the attaching hole and discharge opening are the same as the attachment hole 8*b* and the discharge opening 10 of the bottom portion 8*a* on the reservoir tank 8 of the present embodiment with respect to the attachment hole and the discharge opening on the bottom portion of a reservoir tank, to which a discharge portion main body member according to the above-described comparative example would normally be attached, in which the same affixing portion 58 and the curved portion 76 as in the present embodiment are not formed, and also with respect to the attachment hole and the discharge opening at the bottom portion of a reservoir to which a discharge portion main body member according to still another comparative example would normally be attached, in which the same affixing portion 58 as the present embodiment is formed, and the same curved portion 76 as the present embodiment is not formed, then the discharge portion main body member 48 of the discharge valve apparatus 1 of the present embodiment can be easily attached. Therefore even compared to the case in which these other discharge portion main body members are attached to the attachment hole 8*b* on the bottom portion 8*a* of the reservoir tank 8, a relatively high instantaneous flow rate can be assured without reducing the instantaneous flow rate Q [L/min] of the flush water supplied to the toilet main body portion 4 of a one-piece flush toilet 2 from the reservoir tank 8 through the discharge valve shaft member 80 on the discharge portion main body member 48.

Also, as shown in FIGS. 6, 8, and 11, in the discharge flow path 50 a curved portion 76 contiguous with the lower downstream side curved portion 76*a* is also formed for the wall surface (the inside surface 52*c*) of the side wall portion 52 at the same height as the surface F1 and F2 of the affixing portion 58. In particular, in the region R1 of the discharge flow path 50 formed by the surface F1 of the affixing portion 58 and the curved portion 76 of the wall surface of the side wall portion 52 (the inside surface 52*c*) at the same height as this surface F1, the surface F1 of the affixing portion 58 and the curved portion 76 of the wall surface of the side wall portion 52 (the inside surface 52*c*) at the same height thereof are formed in a mutually curved shape so that the flow path cross sectional surface area S5 of the parts other than the affixing portion 58 in the discharge flow path 50 is essentially the same along the height direction of the affixing portion 58. Thus even if an affixing portion 58 is formed inside the discharge flow path 50 of the discharge portion main body member 48, the flush water W1 is able to flow smoothly along the surface of the curved surfaces F1, F2 or along the curved portion 76 of the affixing portion 58 without peeling away, so a relatively high instantaneous flow rate can be assured. Hence the flush water at a relatively high instantaneous flow rate can be supplied from the reservoir tank 8 to the toilet main body portion 4 of the one-piece flush toilet 2 through the discharge flow path 50 in the discharge portion main body member 48.

In the area R2 formed above the position P at the same height as the innermost portions C1, C2 of the affixing portion 58 downstream of the area R1 inside the discharge flow path 50, the flow path cross sectional surface area S6 of parts other than the affixing portion 58 is set to be smaller than the flow path cross sectional surface area S5 above that, and larger than the flow path cross sectional surface area S1 below that.

In addition, as shown in FIGS. 5 and 8 through 11, the discharge flow path 50 of the discharge portion main body member 48 is formed so that the flow path cross sectional surface area S7 of the discharge flow path 50 increasingly widens going from the top end portion D of the side wall portion 52 wall surface (the inside surface 52*c*) toward the upstream inflow opening 50*b*. Thus when the flush water inside the reservoir tank 8 flows into the discharge flow path 50 from the inflow opening 50*b* in the discharge flow path 50 of the discharge portion main body member 48, it is able to flow smoothly from the inflow opening 50*b* along the wall surface (the inside surface 52*c*) of the discharge flow path 50 without peeling away.

As shown in FIGS. 8 and 11, a valve seat 78 is disposed on the inflow opening 50*b* of the discharge flow path 50 of the discharge portion main body member 48, spanning the entire top edge circumference thereof and protruding upward.

Moreover, a valve body 34 is disposed to be able to make contact on the valve seat 78; as shown by the dot and dash line 34 in FIG. 5, when the valve body 34 contacts the valve seat 78 and closes the inflow opening 50*b* on the discharge flow path 50, the discharge flow path 50 (the discharge opening 10) is placed in a closed state, and the flush water in the valve seat 78 is not supplied to the water conduit 20 in the toilet main body portion 4.

As shown in FIG. 5, the valve body 34 is affixed to the bottom end portion of the discharge valve shaft member 80 extending in the up-down direction. A hook portion 80*a*, to which the operating wire 32 bottom end connecting portion 32*a* is connected so as to be slidable in the up-down direction, is integrally disposed at the top end portion of this discharge valve shaft member 80.

Also, the discharge valve shaft member 80 is disposed to be movable up and down within a housing 82 placed above the discharge portion main body member 48. In particular, the discharge valve shaft member 80 rises by the pulling up of hook portion 80*a* caused by the raising of the single operating wire 32 resulting from the operation of the operating lever 30 on the operating apparatus 28. The valve body 34 rises together with the discharge valve shaft member 80, the opening discharge flow path 50 inflow opening 50*b*, thereby placing the discharge flow path 50 (the discharge opening 10) in an open state so that the flush water in the reservoir tank 8 is supplied to the water conduit 20 in the toilet main body portion 4.

Note that in the valve body 34 shown by a solid line, what is shown is the state wherein the valve body 34 is raised to the maximum rise height (maximum stroke) H1 relative to the valve seat 78, and the toilet flushing is started in the large flush mode. Note that in FIG. 5 the rise height of the valve body 34 in the state wherein the toilet flushing is started in the small flush mode, is shown as H2.

As shown in FIGS. 3 through 5, the discharge portion main body member 48 includes multiple post portions 84 extending up and down from positions spaced apart by a predetermined distance facing outward from the valve seat 78 to the top end portion of the discharge portion main body member 48; these post portions 84 are disposed in the circumferential direction at a predetermined spacing, and form multiple communication openings 86 for allowing the flush water outside the discharge valve apparatus 1 to flow into the discharge flow path 50 (the discharge opening 10) between adjacent the post portions 84.

In addition, as shown in FIGS. 3 through 5, the multiple vertical holes 82*a* are formed in the side surface of the housing 82, and the interior of the housing 82 communicates with the interior of the reservoir tank 8 on the outside thereof by these the multiple vertical holes 82*a*. In this way, the discharge valve shaft member 80 and the valve body 34, when raised relative to the valve seat 78, fall together with the dropping water level in the housing 82 and the reservoir tank 8.

Note that, as shown in FIG. 5, various related members, etc. are disposed inside the housing 82 in addition to the discharge valve shaft member 80 and the valve body 34 to adjust the timing at which toilet flushing is started in the large flush mode and small flush mode, respectively, but an explanation of these related members is here omitted because they are unnecessary to accomplish the minimum function of raising the discharge valve shaft member 80 and the valve body 34 using the operating wire 32.

Also, as shown in FIGS. 3 and 5, in the state existing when the valve body 34 is open in the discharge valve apparatus 1 large flush mode, when the operating lever 30 on the operating apparatus 28 is rotated in the direction executing a predetermined large flush mode, the operating wire 32 is taken up by the predetermined maximum take up amount by the wire take-up apparatus 46 in the operating apparatus 28, the discharge valve shaft member 80 and the valve body 34 are lifted to a maximum rise height (maximum stroke) H1, higher than the rise height H2 in the small flush mode (H1>H2), a relatively large volume of the flush water is supplied from the reservoir tank 8 to the water conduit 20 in the toilet main body portion 4 of the one-piece flush toilet 2, and the toilet flushing in the large flush mode is started.

At the same time, as shown in FIGS. 3 and 5, in a state wherein the valve body 34 is open in the discharge valve apparatus 1 small flush mode, when a user rotates the operating lever 30 in a direction to execute a predetermined small flush mode, the wire take-up apparatus 46 of the operating apparatus 28 takes up the operating wire 32 by a take-up amount less than the maximum take-up amount in the large flush mode case; the discharge valve shaft member 80 and the valve body 34 are lifted to rise height H2 at the start of the small flush mode, lower than the maximum rise height (maximum stroke) at the start of the large flush mode, and a volume of the flush water smaller than the flush water volume resulting from the large flush mode is supplied from the inside reservoir tank 8 to the water conduit 20 of the toilet main body portion 4 in the one-piece flush toilet 2, thereby starting a toilet flush in the small flush mode.

Also, as shown in FIG. 3 and FIG. 5, in the discharge valve apparatus 1, the valve body 34 drops together with the drop in water level as it carries out predetermined actions after being pulled up by the operating wire 32 in response to the amounts by which the operating wire 32 is respectively raised in the large flush mode and small flush mode. As shown by the dot and dash line in FIG. 5, the valve body 34 contacts the valve seat 78 and the discharge opening 10; more precisely the inflow opening 50*b* on the discharge flow path 50 is placed in a closed state, wherein the discharge of the discharge valve apparatus 1 in the large flush mode or small flush mode ends. The flush water inside the reservoir tank 8 is accumulated by the supply of water from the water supply apparatus 26 up to a predetermined shut off water level (full water level W0).

Next, referring to FIGS. 1 through 12, we discuss the operation and effect of a discharge valve apparatus according to an embodiment of the invention.

As shown in FIGS. 1 through 11, when a user rotates operating lever 30 in the operating apparatus 28 in a predetermined direction to start a toilet flush in either the large flush mode or small flush mode, the operating wire 32 is taken up by the wire take-up apparatus 46 on the operating apparatus 28 and raised; in the large flush mode discharge valve shaft member 80 and the valve body 34 rise to the maximum rise height H1; in the small flush mode discharge valve shaft member 80 and the valve body 34 rise to a predetermined rise height H2, lower than the maximum rise height H1, and the inflow opening 50*b* on the discharge flow path 50 of the discharge portion main body member 48 is opened.

Flush water in the reservoir tank 8 flows from the outside to the inside of the communication openings 86 on the discharge portion main body member 48, and flows into the discharge flow path 50 from the inflow opening 50*b* on the discharge flow path 50, while at the same time the flush water inside the housing 82 flows into discharge flow path 50 from the inflow opening 50*b* on the discharge flow path 50.

Next, as shown in FIGS. 10 and 11, the flush water W1 which has flowed into the discharge flow path 50 from the inflow opening 50*b* on the discharge flow path 50 flows smoothly without peeling away along the wall surface of the discharge flow path 50 (the inside surface 52*c*) from the inflow opening 50*b*, maintaining a relatively high predetermined instantaneous flow rate (e.g., Q1=200 [L/min]) at or above a predetermined instantaneous flow rate Q1. When passing over affixing portion 58, the flush water flows smoothly, without peeling away, along the curved surfaces F1, F2 of the affixing portion 58, maintaining a relatively high predetermined instantaneous flow rate (e.g., Q1=200 [L/min]) at or above a predetermined instantaneous flow rate Q1.

At the same time, the flush water W1, which flows along the wall surface of the discharge flow path 50 (the inside surface 52*c*), although it does not pass close to the affixing portion 58, flows smoothly, without peeling away, along the surface of curved portion 76 to the downstream side curved portion 76*a*, maintaining a relatively high predetermined instantaneous flow rate (e.g., Q1=200 [L/min]) at or above a predetermined instantaneous flow rate Q1. The flush water W1 flowing along the surface of the downstream side curved portion 76*a*, which curves so as to spread gradually outward in the downward direction, flows out from the outflow opening 50*a*, maintaining a relatively high predetermined instantaneous flow rate (e.g., Q1=200 [L/min]) at or above a predetermined instantaneous flow rate Q1, and is supplied to the water conduit 20 in the toilet main body portion 4. The flush water in the water conduit 20 is respectively spouted from the first rim spout opening 22 and the second rim spout opening 24; the bowl portion 12 is flushed, and waste is discharged from the discharge trap conduit 18.

Figure 12:
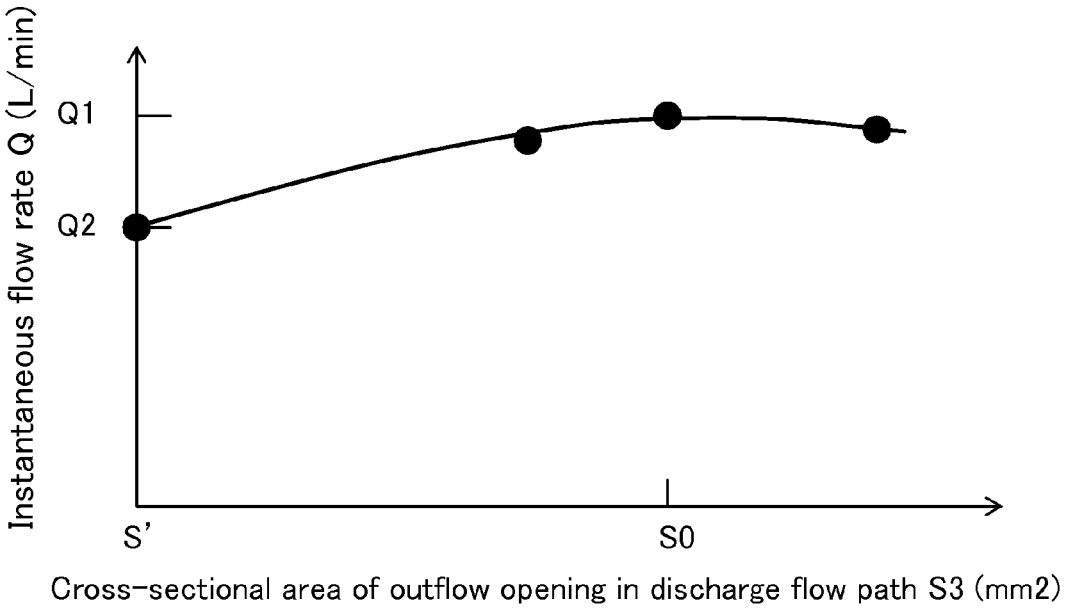
FIG. 12 is a qualitative representation of experimental research results regarding the relationship between cross sectional surface area and instantaneous flow rate in the outflow opening of a discharge flow path in a discharge portion main body member using a discharge valve apparatus according to an embodiment of the invention.

Next, FIG. 12 is a qualitative representation of experimental research results regarding the relationship between the cross sectional surface area and the instantaneous flow rate in the outflow opening of the discharge flow path in a discharge portion main body member using a discharge valve apparatus according to an embodiment of the invention.

Here the horizontal axis in FIG. 12 indicates a flow path cross sectional area S3 [$mm^2$] of the outflow opening 50*a* in the discharge flow path 50 of the discharge portion main body member 48 of the discharge valve apparatus 1 of the embodiment; the vertical axis in FIG. 12 indicates the instantaneous flow rate Q [L/min] in the outflow opening 50*a* in the discharge flow path 50 of the discharge portion main body member 48 of the discharge valve apparatus 1 of the embodiment.

As shown in FIG. 12, when the flow path cross sectional surface area S3 of the outflow opening 50*a* of the discharge flow path 50 in the discharge portion main body member 48 of the discharge valve apparatus 1 of the present embodiment is set to a predetermined flow path cross sectional surface area S0 (e.g., S0=2600 [$mm^2$]), instantaneous flow rate Q becomes instantaneous flow rate Q1 (e.g., Q1=200 [L/min]), and it can be seen that an ideal instantaneous flow rate is attained, with which sufficient toilet flushing performance is assured.

As a comparative example, when the flow path cross sectional surface area S' is made uniform across the entire flow path from the inflow opening to the outflow opening of the discharge flow path in a discharge portion main body member, and the flow path cross sectional surface area S3 of an outflow opening 50*a* in discharge flow path 50 is set to a predetermined flow path cross sectional surface area S' (e.g., S'=2300 [$mm^2$]), instantaneous flow rate Q becomes an instantaneous flow rate Q2 (e.g., Q2=160 [L/min]) smaller than maximum instantaneous flow rate Q1, and it can be seen that compared to instantaneous flow rate Q1, it is then difficult to obtain sufficient toilet flushing performance.

Since air inside water conduit 20 of toilet main body portion 4 at the bottom of outflow opening 50*a* on discharge flow path 50 is more easily pulled into discharge flow path 50 in proportion to the degree to which flow path cross sectional surface area S3 is set to be larger than flow path cross sectional surface area S0, there is a tendency for instantaneous flow rate Q to drop more than maximum instantaneous flow rate Q1, so it is also clear that care should be taken not to set the flow path cross sectional surface area S3 of the outflow opening 50*a* on the discharge flow path 50 too high.

In a discharge valve apparatus 1 according to the above-described embodiment of the present invention, the flow path cross sectional surface area S1 of parts other than the affixing portion 58 inside the discharge flow path 50 of the discharge portion main body member 48 at the same height as the innermost portions C1, C2 of the affixing portion 58 is minimum, but on the wall surface of the side wall portion 52 (the inside surface 52*c*) forming the discharge flow path 50 in the area downstream of these innermost portions C1, C2, a curved portion 76 (the downstream side curved portion 76*a*), curved so as to gradually widen outward in the downward direction, is formed so that the flow path cross sectional surface area S2 of parts other than the affixing portion 58 gradually expands toward the downstream side, therefore even if the affixing portion 58 is formed to project into the discharge flow path 50 of the discharge portion main body member 48, a relatively high instantaneous flow rate is obtained with respect to the instantaneous flow rate Q [L/min] of the flush water passing through the discharge flow path 50 of the discharge portion main body member 48.

E.g., as in the comparative example shown by the dot and dash line V1 in FIGS. 8 and 11, essentially the same instantaneous flow rate can be attained as when the inside surface V1 of the side wall portion thereof extends vertically with no affixing portion 58 provided, and a discharge portion main body member, in which the flow path cross sectional surface area S' of the discharge flow path thereof is essentially fixed over the entire flow path area from the inflow opening to the outflow opening, is attached to an attachment hole 8*b* of the same diameter on the bottom portion 8*a* of the reservoir tank 8.

Even comparing the flow path of a discharge main body member according to still another comparative example, in which the inside surface V1 on the side wall extends vertically and the same affixing portion 58 as in the embodiment is provided in the discharge flow path, but the same curved portion 76 as in the embodiment is not formed on side wall portion inside surface V1 of the discharge flow path, a large instantaneous flow rate Q [L/min] can be set for flush water flowing through the discharge flow path 50 of the discharge portion main body member 48, due to the space inside the discharge flow path 50 formed by the curved portion 76.

Therefore flush water which has flowed into discharge flow path 50 of discharge portion main body member 48 from reservoir tank 8 can be efficiently supplied to the toilet main body portion 4 of one-piece flush toilet 2, and the flushing performance of the one-piece flush toilet 2 can be improved.

Moreover, according to a discharge valve apparatus 1 of the present embodiment, with respect to a reservoir tank discharge opening to which a discharge portion main body member not provided with the same type of affixing portion 58 as in the embodiment on the inside surface V1 of the side wall portion extending in the vertical direction of a discharge flow path would normally be attached, according to a comparative example different from the discharge portion main body member 48, so long as the discharge opening is of the same diameter as the discharge opening 10, to which the discharge valve apparatus 1 of the embodiment is applied, the discharge portion main body member 48 of the discharge valve apparatus 1 of the embodiment can be easily attached to the attachment hole in the bottom portion of the reservoir tank. With respect as well to a reservoir tank discharge opening to which a discharge portion main body member provided with the same type of affixing portion 58 on the inside surface V1 of the side wall portion extending in the vertical direction of a discharge flow path as in the embodiment, but in which the same type of curved portion 76 as in the embodiment is not formed, would normally be attached according to still another comparative example different from the discharge portion main body member 48, so long as the discharge opening is of the same diameter as the discharge opening 10 to which the discharge valve apparatus 1 of the embodiment is applied, the discharge portion main body member 48 of the discharge valve apparatus 1 of the embodiment can be easily attached to the attachment hole in the bottom portion of the reservoir tank. Therefore even compared to the case in which these other discharge portion main body members are attached to the attachment hole 8*b* on the bottom portion 8*a* of the reservoir tank 8, a relatively high instantaneous flow rate can be assured without reducing the instantaneous flow rate Q [L/min] of the flush water supplied to the toilet main body portion 4 of the one-piece flush toilet 2 from the reservoir tank 8 through the discharge flow path 50 of the discharge portion main body member 48. Therefore standardization of the discharge valve apparatus 1 can be applied to various toilets and reservoir tanks, improving ease of use.

In the discharge valve apparatus 1 according to the embodiment, because the surfaces F1, F2 of the affixing portion 58 which forms the discharge flow path 50 of the discharge portion main body member 48 are formed in a mutually contiguous curved shape, and surface F1 and F2 are both in the entirety formed as essentially a semispherical shape, when the flush water inside the reservoir tank 8 flows from the inflow opening 50*b* in the discharge portion main body member 48 into the discharge flow path 50 and passes over the curved surfaces F1, F2 of the affixing portion 58, that the flush water is able to flow smoothly along the curved surfaces F1, F2 of the affixing portion 58 without peeling away. Hence the flush water can be supplied at a relatively high instantaneous flow rate from the reservoir tank 8 to the toilet main body portion 4 on the one-piece flush toilet 2. Therefore even if the affixing portion 58 is formed inside the discharge flow path 50 of the discharge portion main body member 48, the flush water passing from the reservoir tank 8 into the discharge flow path 50 of the discharge portion main body member 48 and over the affixing portion 58 can be supplied at a relatively high instantaneous flow rate to the toilet main body portion 4 of the one-piece flush toilet 2 without being impeded, and the flushing performance of the one-piece flush toilet improved.

Moreover, in discharge valve apparatus 1 according to the embodiment, in the discharge flow path 50 of the discharge portion main body member 48, the surface F1 from the peaks A1, A2 of the head portions 60*a*, 62*a* of each of the screws 60, 62 to the top end portion B of the surfaces of the countersunk screw attaching portions 68, 70, and the curved portion 76 of the wall surface (inside surface 52*c*) of the side wall portion 52 at the same height as this surface F1, respectively includes an area R1 formed in a curved shape so that the flow path cross sectional surface area S5 of parts inside the discharge flow path 50 other than the affixing portion 58 is essentially the same along the height direction of the affixing portion 58, therefore even if the affixing portion 58 is formed inside the discharge flow path 50 of the discharge portion main body member 48, the flush water W1 is able to flow smoothly along the curved surfaces F1, F2 of the affixing portion 58 and the surface of the curved portion 76 without peeling away, so that a relatively high instantaneous flow rate can be secured. Therefore the flush water which has flowed through the discharge flow path 50 of the discharge portion main body member 48 from the reservoir tank 8 can be supplied at a relatively high instantaneous flow rate to the toilet main body portion 4 of the one-piece flush toilet 2, and the flushing performance of the one-piece flush toilet 2 can be improved.

Also, in the discharge valve apparatus 1 according the embodiment, the flow path cross sectional surface area S2 of the discharge flow path 50 is formed to expand more and more as the discharge flow path 50 on the discharge portion main body member 48 approaches the upstream inflow opening 50*b* from the top end portion D on the wall surface (the inside surface 52*c*) of the side wall portion 52 thereof, so that when the flush water W1 in the reservoir tank 8 flows into the discharge flow path 50 from the inflow opening 50*b* in the discharge flow path 50 of the discharge portion main body member 48, it is able to flow smoothly from the inflow opening 50*b* along the wall surface (the inside surface 52*c*) of the discharge flow path 50 without peeling away. Therefore the flush water which has flowed through the discharge flow path 50 of the discharge portion main body member 48 from the reservoir tank 8 can be supplied at a relatively high instantaneous flow rate to the toilet main body portion 4, and the flushing performance of the one-piece flush toilet 2 can be improved.

In addition, in a discharge valve apparatus 1 according to the embodiment, by attaching the discharge valve apparatus 1 to the discharge opening 10 on the flush water tank portion 6, the flush water can be supplied from the flush water tank portion 6 to the toilet main body portion 4 at a relatively high instantaneous flow rate, and the one-piece flush toilet 2 capable of improving toilet performance can be provided.

What is claimed is:

1. A discharge valve apparatus attached to a discharge opening of a flush water tank configured to store flush water used to flush a toilet, the discharge valve apparatus comprising:

a discharge portion main body attached to the discharge opening and forming an inside of a flow path configured to guide flush water from an inflow opening formed at one end thereof to an outflow opening formed at the other end thereof;

a discharge valve body configured to open and close the inflow opening of the discharge portion main body; and an affixing portion formed to project into the flow path of the discharge portion main body, the affixing portion being configured to affix the discharge portion main body to the flush water tank;

wherein the discharge opening of the flush water tank is disposed on a bottom of the flush water tank, the discharge opening being configured to penetrate the bottom of the flush water tank in a vertical direction, wherein a wall surface of the flow path in the discharge portion main body at the same height as the affixing portion includes a curved portion, the curved portion being configured to curve and widen outward in a downward direction so as to expand a cross-sectional area of the flow path, wherein the affixing portion includes a curved surface which curves in a height direction of the affixing portion, the curved surface forming the flow path, and wherein the curved surface of the affixing portion and the curved portion of the wall surface are configured to form an area in which the cross-sectional area of the flow path is essentially the same along the height direction of the affixing portion so that the discharge valve apparatus is configured to be a common shared discharge valve apparatus to both one-piece and two-piece flush toilets.

2. The discharge valve apparatus according to claim 1, wherein the flow path in the discharge portion main body is formed so that the cross-sectional area of the flow path expands as it goes from a top end portion of the wall surface of the flow path toward an upstream of the inflow opening.

3. One-piece flush toilet, comprising:

a flush water tank wherein the discharge valve apparatus according to claim 1 is attached to the discharge opening; and a toilet body with which the flush water tank is integrally formed.

* * * * *